US005452856A

United States Patent [19]

Pritchard

[11] Patent Number: 5,452,856

[45] Date of Patent: Sep. 26, 1995

[54] SPRAY WAND WITH SPRAY FAN CONTROL

[75] Inventor: James Pritchard, Somersworth, N.H.

[73] Assignee: Davidson Textron, Inc., Dover, N.H.

[21] Appl. No.: 166,068

[22] Filed: Dec. 10, 1993

[51] Int. Cl.[6] ..... B05B 7/08

[52] U.S. Cl. ..... 239/297; 239/300

[58] Field of Search ..... 239/290, 295, 239/296, 297, 300, 424.5, 418

[56] References Cited

U.S. PATENT DOCUMENTS

| | | | |
|---|---|---|---|
| 1,777,925 | 10/1930 | Kollmann | 239/297 |
| 2,410,532 | 11/1946 | Tessier . | |
| 3,252,657 | 5/1966 | Winegar . | |
| 3,335,956 | 8/1967 | James . | |
| 3,741,482 | 6/1973 | Eliason et al. | 239/296 |
| 3,848,807 | 11/1974 | Partida . | |
| 4,343,433 | 8/1982 | Sickles | 239/300 |
| 4,531,675 | 7/1985 | Muck . | |
| 4,618,098 | 10/1986 | Hedger, Jr. et al. . | |
| 4,647,471 | 4/1988 | Jenkins . | |
| 4,747,627 | 5/1988 | Shigeura et al. . | |
| 4,915,303 | 4/1990 | Hufgard . | |
| 4,928,884 | 5/1990 | Smith . | |
| 4,954,059 | 9/1990 | Lee et al. | 239/296 |
| 4,970,985 | 11/1990 | Slautterback | 239/296 |
| 5,062,572 | 11/1991 | Reiter et al. . | |
| 5,307,992 | 5/1994 | Hall et al. | 239/296 |

FOREIGN PATENT DOCUMENTS

| | | | |
|---|---|---|---|
| 2822687 | 12/1978 | Germany | 239/297 |

*Primary Examiner*—Andres Kashnikow
*Assistant Examiner*—Christopher G. Trainor
*Attorney, Agent, or Firm*—Reising, Ethington, Barnard, Perry & Milton

[57] ABSTRACT

A nozzle assembly (16), for spraying a liquid such as a urethane prepolymer on a substrate, has a liquid spray nozzle (28) with a center line (56). Air nozzles (30), with center lines (62) that are substantially parallel to the center line (56) of the liquid spray nozzle (28), are provided in the nozzle assembly (16) around the liquid spray nozzle. Air passing from the air nozzles (30) surrounds and encloses the liquid spray and decreases the size of the liquid spray fan pattern (58 or 70). The air spray nozzles (30) can be positioned in the nozzle assembly (16) to change the shape of the liquid spray fan pattern (58 or 70) as well as the size. Mixing of air and liquid is minimized by spraying air and liquid in parallel paths.

12 Claims, 2 Drawing Sheets

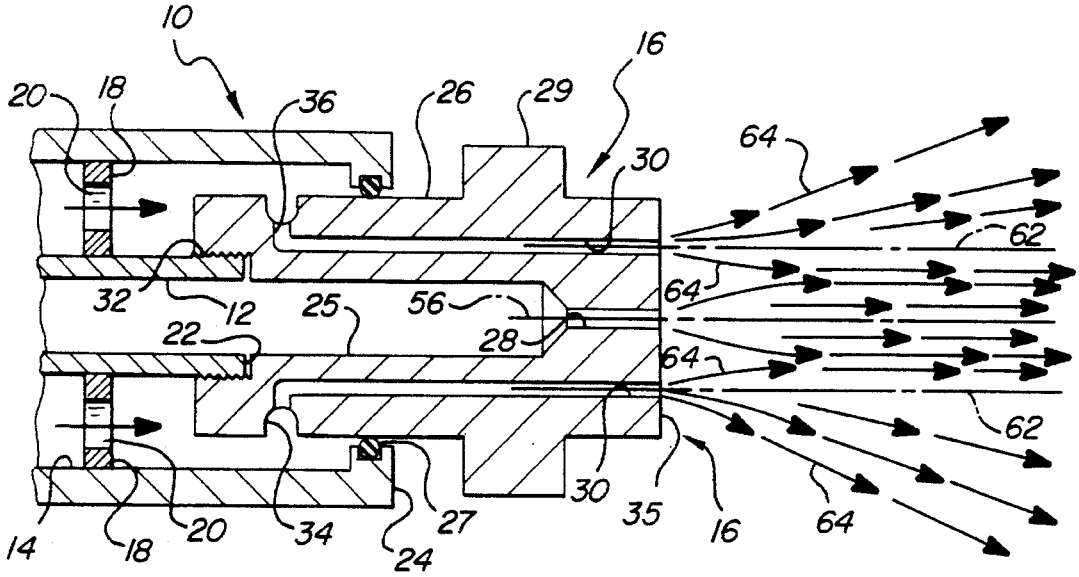
FIG-1
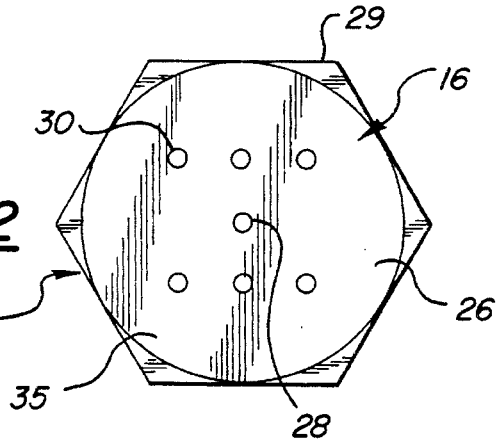
FIG-2
FIG-3
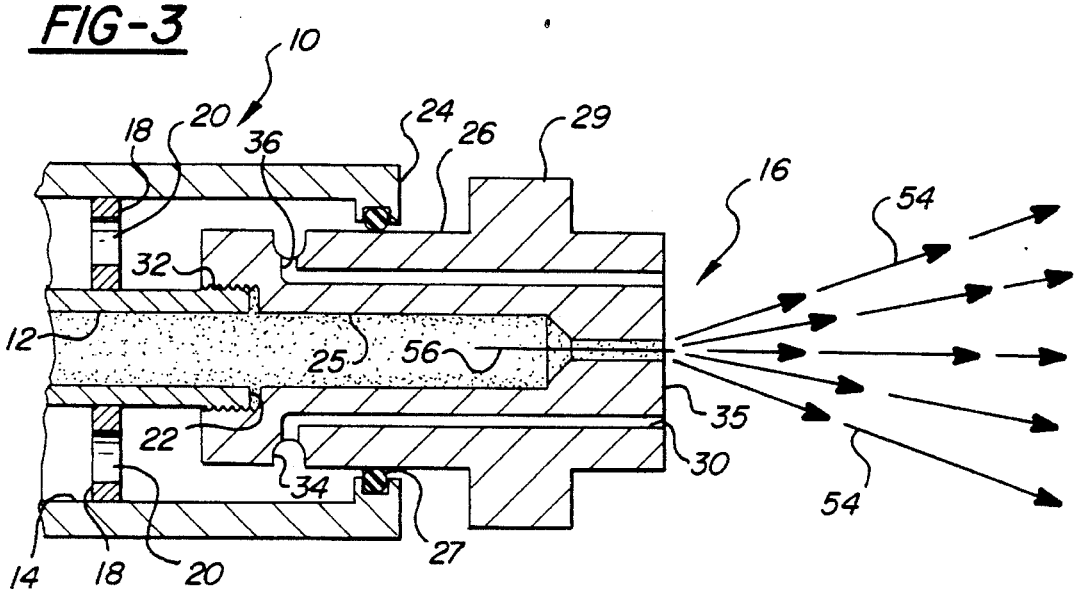

SPRAY WAND WITH SPRAY FAN CONTROL

TECHNICAL FIELD

The invention relates to the control of the size and shape of the spray fan from a nozzle on a spray wand and, more particularly, to a spray wand with a fluid spray nozzle and a plurality of gas nozzles that supply gas jets to control the size and shape of the fluid spray fan.

BACKGROUND OF THE INVENTION

Paint guns with a nozzle assembly having one central nozzle for a mixture of air and paint and other nozzles for air that change the shape of the paint spray fan are well known. The air nozzles direct air into the mixture of air and paint leaving the central nozzle. The air from the air nozzles mixes with the paint and air leaving the central nozzle and changes the shape of the paint spray fan. Adjustments are provided to vary the pressure of air supplied to the air nozzles and thereby adjust the size and shape of the paint spray fan. The nozzle assembly is generally rotatable relative to the nozzle assembly holder to change the orientation of the paint spray fan. Air nozzles that direct air against opposite sides of a stream of paint and air passing through a central nozzle reduce the width of the spray fan in one direction and spread the spray fan in another direction to create an oval spray fan. The dimensions of the oval spray fan can be changed by changing the pressure of the air supplied to the air nozzles. The volume of air mixed with paint can vary over a relatively wide range without adversely affecting a paint spray system. The orientation of the spray fan can be changed by rotating the nozzle assembly relative to a nozzle assembly holder.

Nozzle assemblies are available with a central nozzle that sprays a resin and other nozzles which spray a catalyst into the resin and change the shape of the resin spray fan. The primary function of such nozzle assemblies is to mix the resin and the catalyst. These nozzle assemblies cannot make significant changes in the resin spray fan without adding too much or too little catalyst to the resin. To eliminate waste and reduce cost it is desirable to provide a correct quantity of catalyst to activate the resin. Excess catalyst sprayed into the resin will be wasted and spraying an inadequate quantity of a catalyst will result in incomplete activation of the resin.

The mixture of a gas or liquid with a liquid sprayed from a primary nozzle is undesirable in some processes. When making a urethane foam, for example, by a reaction injection molding process, liquid urethane prepolymers are sprayed onto a substrate and then heat is applied in a mold to cure the polymer. A gas mixed with the liquid is undesirable. Such a gas can interfere with heat transferred during curing and may cause voids in the urethane foam. Current systems for spraying liquid urethane polymers on a substrate either apply the liquid through a nozzle with a small spray fan or apply liquid through a nozzle with a large spray fan. The spray fans are not adjustable during operation. Nozzles with a small spray fan take longer to apply a liquid urethane prepolymer. Nozzles with a relatively large spray fan over spray and waste material when spraying on small areas of a substrate. It is undesirable to apply a liquid prepolymer at a relatively slow rate on large flat areas of a substrate or to waste liquid polymer through over spray when applying a liquid prepolymer to a small area of a substrate.

SUMMARY OF THE INVENTION

An object of the invention is to provide a spray wand with an adjustable spray fan.

Another object of the invention is to provide a spray wand having a liquid nozzle in combination with gas nozzles that adjust the size and shape of the liquid spray fan.

A further object of the invention is to provide a spray wand with gas nozzles that adjust the size and shape of a liquid nozzle spray fan and minimize mixing of the gas and the liquid.

The spray wand includes a nozzle assembly with a liquid nozzle for depositing a liquid such as urethane prepolymers on a substrate. The nozzle assembly also includes a plurality of gas nozzles that are adjacent to the liquid nozzle. The gas nozzles supply a ring of gas that surrounds and encloses the liquid spray. By increasing the quantity of gas surrounding the liquid spray, expansion of the liquid spray is decreased and the liquid spray fan is decreased in size. The volume of gas is controlled by controlling the pressure of gas supplied to the gas nozzles. The shape of the liquid spray fan is determined primarily by the location of the gas nozzles. The shape of the liquid spray fan can also be changed by varying the quantity of gas supplied between individual gas nozzles. A gas nozzle which supplies a large quantity of gas will reduce the expansion of the liquid spray fan more than another gas nozzle which supplies a smaller quantity of gas in another location adjacent to the liquid spray fan.

The gas nozzles each have a central axis that is parallel to the central axis of the liquid spray nozzle. By positioning the axies of the gas nozzles parallel to the axis of the liquid spray nozzle, turbulence between the gas and the liquid spray is minimized and the velocity difference between the liquid spray and the gas is minimized. Minimizing turbulence and velocity differences reduces mixing between the gas and the liquid spray that is surrounded by the gas.

Other objects, advantages and novel features of the present invention will become apparent when the following detailed description of the preferred embodiment is considered in light of the drawing.

BRIEF DESCRIPTION OF THE DRAWING

FIG. 1 is a cross-sectional view of a wand showing a liquid urethane prepolymers spray nozzle, two air nozzles, the flow of liquid spray through the liquid urethane prepolymers spray nozzle and the flow of air through the air nozzles;

FIG. 2 is an end view of the wand showing one possible arrangement of the air nozzles;

FIG. 3 is a cross-sectional view of a wand showing the flow of liquids through the liquid urethane polymer spray nozzle when there is no flow of air through the air nozzles;

DETAILED DESCRIPTION OF THE PREFERRED EMBODIMENT

Figure 4:
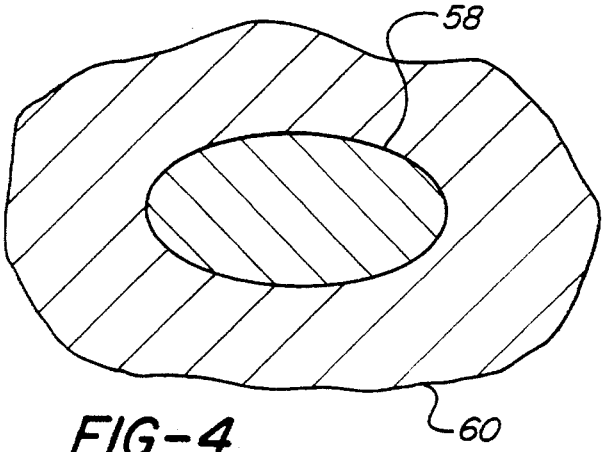
FIG. 4 is a view of the spray fan pattern of air and liquid obtained with the air nozzle arrangement of FIG. 2, in a plane perpendicular to the center line of the orifice that forms the liquid urethane prepolymer nozzle and between the wand and a substrate receiving the liquid urethane prepolymers.

The spray wand 10 is used for spraying liquid urethane prepolymers on a substrate. The substrate could, for example, be a portion of an automotive instrument panel. The substrate for an automotive instrument panel may have large flat areas as well as narrow strips. The liquid urethane prepolymer is sprayed on the substrate with a substantially uniform thickness. The substrate is placed in a mold and heated to cure the liquid urethane prepolymer and form a urethane foam polymer. The spray wand 10 includes a liquid urethane prepolymer supply duct 12 and a compressed air supply duct 14 that is co-axial with the liquid urethane prepolymer supply duct. A nozzle assembly 16 is mounted in the delivery end of the spray wand 10.

The air supply duct 14 is a pipe at the delivery end of the spray wand 10. The liquid urethane prepolymer supply duct 12 is pipe mounted in and co-axial with the air supply duct 14. The liquid urethane prepolymer supply duct 12 is held in a fixed position within the air supply duct 14 by duct mounting rings 18 with multiple air passages 20. The discharge end 22 of the liquid urethane prepolymer supply duct 12 is in the center of the air supply duct 14 and spaced from the discharge end 24 of the air supply duct.

The nozzle assembly 16, as shown in the drawing, is a cylindrical body 26 with a central liquid spray nozzle 28 and a plurality of air nozzles 30 around the central liquid spray nozzle. The central liquid spray nozzle 28 and the air nozzles 30 are orifices drilled through the cylindrical body 26 as shown. The diameter of each orifice is chosen to provide the desired air or liquid flow. If desired, a separate nozzle could be inserted into bores through the cylindrical body 26. With separate nozzles, individual nozzles could be changed to change nozzle orifice size rather than changing the entire nozzle assembly 16.

The cylindrical body 26 of the nozzle assembly 16 is telescopically received within the air supply duct 14. A threaded bore coaxial with one end of a liquid passage bore 25, in the center of the cylindrical body 26, receives and screws onto a threaded portion 32 of the discharge end 22 of the liquid urethane prepolymer supply duct 12. An O-ring 27 seals between the discharge end 24 of the air supply duct 14 and the cylindrical body 26 of the nozzle assembly 16. A hexagon shaped portion 29 of the nozzle assembly 16 is engagable with a hand tool to tighten the nozzle assembly 16 on the threaded portion 32 of the liquid urethane prepolymer supply duct 12. The passages that form the air nozzles 30 in the cylindrical body 26 are connected to a groove 34 in the cylindrical body by radial passages 36 as shown in FIGS. 1 and 3. The radial passages 36 and the groove 34 allow air nozzles 30 to be bored any place within the cylindrical body 26 and around the liquid passage bore 25. The groove 34 is within the air supply duct 14 and receives air from the air supply duct. The bores which form the central liquid spray nozzle 28 and the air nozzles 30 all pass through a flat surface 35 on the discharge end of the nozzle assembly 16.

Figure 8:
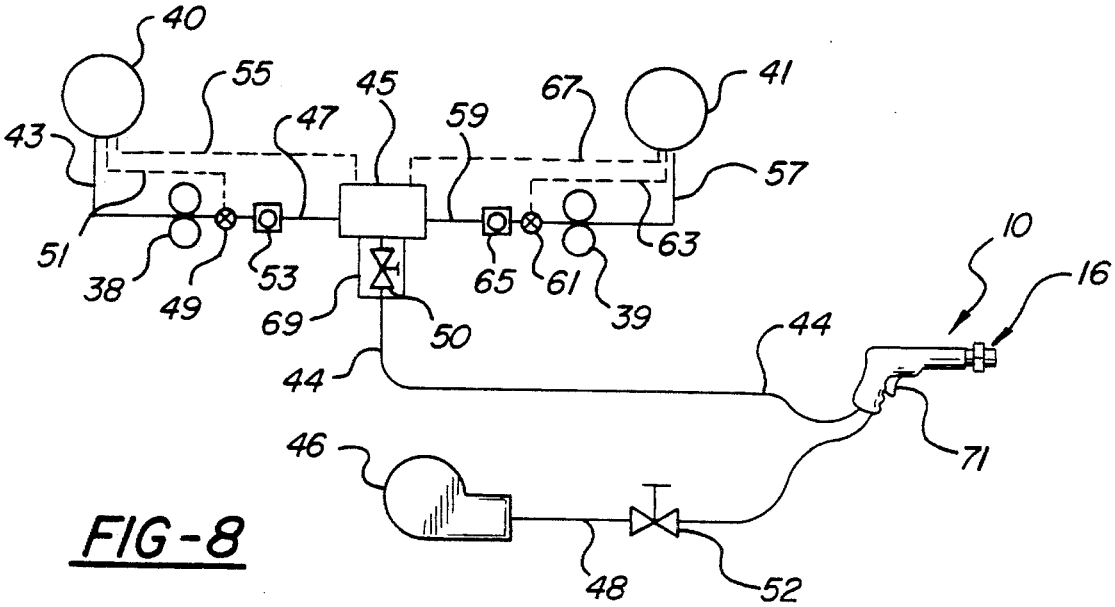
FIG. 8 is schematic diagram showing pumps and valves for spraying liquid urethane prepolymers and air to a wand.

FIG. 8 is a schematic diagram showing the metering system for supplying liquid urethane prepolymer and air to a spray wand 10. The liquid urethane prepolymer is supplied by a reaction injection molding (RIM) metering system. The RIM metering system includes an isocyanate blend storage tank 40 and a polyol blend storage tank 41. A high pressure pump 38 draws isocyanate from the isocyanate blend storage tank 40 through a pipe 43 and supplies isocyanate to a mixing head 45 through a pipe 47. A diverter valve 49 in the pipe 42 can divert isocyanate back to the isocyanate blend storage tank 40 through a return pipe 51. A mass flow meter 53 is provided in the pipe 47 to measure the flow rate of isocyanate to the mixing head 45. A return line 55 is provided to return isocyanate to the isocyanate blend storage tank 40 when flow from the mixing head 45 to the spray wand 10 is blocked. A high pressure pump 39 draws polyol from the polyol blend storage tank 41 through a pipe 57 and supplies polyol to the mixing head 45 through a pipe 59. A diverter valve 61 in the pipe 59 can divert polyol back to the polyol blend storage tank 41 through a return pipe 63. A mass flow meter 65 is provided in the pipe 59 to measure the flow rate of polyol to the mixing head 45. A return line 67 is provided to return polyol to the polyol blend storage tank 41 when flow from the mixing head 45 to the spray wand 10 is blocked. A prepolymer of mixed polyol and isocyanate are conveyed from the mixing head 45 to the spray wand 10 through a liquid supply line 44. The prepolymer begins to react as soon as the isocyanate and the polyol mix in the mixing head 45.

A flush block 69 with a solenoid operated valve 50 cuts off the supply of liquid from the mixing head 45 to the spray wand 10 when the desired amount of liquid urethane prepolymer has been dispensed through the spray wand. A flush valve in the flush block 69 opens, after the solenoid operated valve 50 closes, and the liquid supply line 44 and the spray wand 10 are flushed.

An air compressor 46 is connected to the compressed air supply duct 14 in the spray wand 10 by an air supply line 48.

A solenoid operated valve 52 is provided in the air supply line 48 to control the flow of compressed air to the compressed air supply duct 14 and to the air nozzles 30 at the discharge end of the spray wand 10. The solenoid operated valve 52 controls the pressure of the air supplied to the spray wand 10 to control the flow of air through the air nozzles 30 and vary the flow of air as required. At least a portion of the liquid supply line 44 and the air supply line 48 are flexible lines that allow the spray wand 10 to move relative to the air compressor 46 and the liquid pump 38. The spray wand 10 will normally be attached to a computer controlled robot that moves the spray wand along a predetermined path relative to a substrate. A valve 71 can be provided in the spray wand 10 to cut off and to start the flow of air and liquid from the spray wand. The valve 71 can be operated manually or by a solenoid.

Liquid urethane prepolymers, supplied to a spray wand 10 under pressure by a liquid pump 38, is accelerated as it passes through a liquid spray nozzle 28. After passing through the liquid spray nozzle 28, the liquid tends to slow down and spread out following a path indicated by the arrows 54 shown in FIG. 3. The spray fan from the liquid spray nozzle 28 will produce a circular pattern upon striking a substrate surface when the liquid spray nozzle has an orifice with a circular cross section and a center line 56 and when the surface of the substrate is perpendicular to the center line and no fluid passes through the air nozzles 30.

The six air nozzles 30 spaced along two parallel spaced apart straight lines and around the central liquid spray nozzle 28 as shown in FIG. 2 will produce the spray fan pattern shown in FIG. 4. The liquid urethane prepolymer spray fan pattern 58 is generally oval and is surrounded by air and an air spray fan pattern 60 that is generally oval with some irregularities. Each of the air nozzles 30 has a circular cross section and a center line 62. The center lines 62 of the air nozzles 30 are parallel to the center line 56 of the liquid spray nozzle 28. The passage of air through the air nozzles 30 tends to limit expansion of the spray fan 58 of the liquid urethane prepolymers. The passage of air through the air nozzles 30 also tends to maintain the speed at which the liquid urethane prepolymer is traveling when it leaves the liquid spray nozzle 28. Compressed air as it leaves the air nozzles 30 moves along paths indicated by the arrow 64 in FIG. 1. The flow of liquid urethane prepolymer spray from the liquid spray nozzle 28 limits expansion of the air toward the center line 56 of the liquid spray nozzle. The flow of air through the air nozzles 30 tends to limit expansion of the liquid urethane prepolymer spray toward the center line 62 of the air nozzles 30. The velocity of the liquid urethane prepolymer spray decreases relatively slowly because the adjacent air is traveling in the same direction thereby reducing friction between the moving air and the liquid urethane prepolymer spray. The decreased cross-sectional area of the liquid urethane prepolymer spray, as a result of containment between streams of moving air passing through the air nozzles 30, reduces the volume of gas pushed by the liquid urethane prepolymer thereby further reducing the rate of deceleration of the liquid urethane prepolymer spray.

The moving air from the air nozzles 30 is moving in substantially the same direction as the liquid urethane prepolymer spray because the center lines 62 of the air nozzles 30 are parallel to the center line 56 of the liquid spray nozzle 28. This reduces turbulence between the liquid urethane prepolymer spray and the surrounding air. By reducing turbulence mixing of air with liquid urethane prepolymers spray is reduced. Air mixed with a liquid urethane prepolymers can reduce heat transfer and interfere with curing of the urethane foam polymer.

Figure 5:
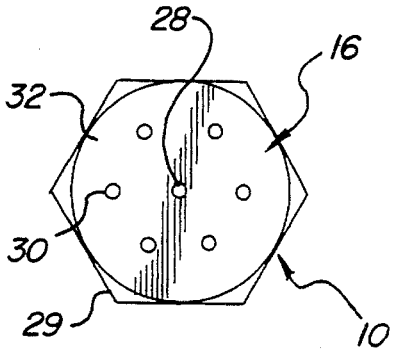
FIG. 5 is an end view of a wand with a nozzle assembly air nozzles arranged to provide a substantially circular liquid spray fan pattern.

Air nozzles 30 arranged in a circle around a liquid spray nozzle 28, as shown in FIG. 5 will produce a substantially circular liquid prepolymer spray fan pattern. The liquid prepolymer spray fan that results from passing compressed air through air nozzles 30 arranged in a circle with a liquid spray nozzle 28 in the center of the circle will be smaller in diameter than the spray fan of the liquid spray nozzle 28 when compressed air is not supplied to the air nozzles. The size of the liquid spray fan can be varied by changing the pressure of the air supplied to the air nozzles 30.

Figure 6:
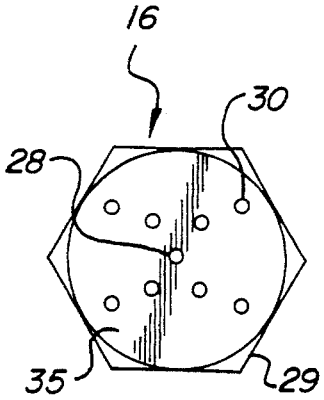
FIG. 6 is an end view of the discharge end of a wand with the air nozzles of the nozzle assembly arranged to provide an alternate spray fan.
Figure 7:
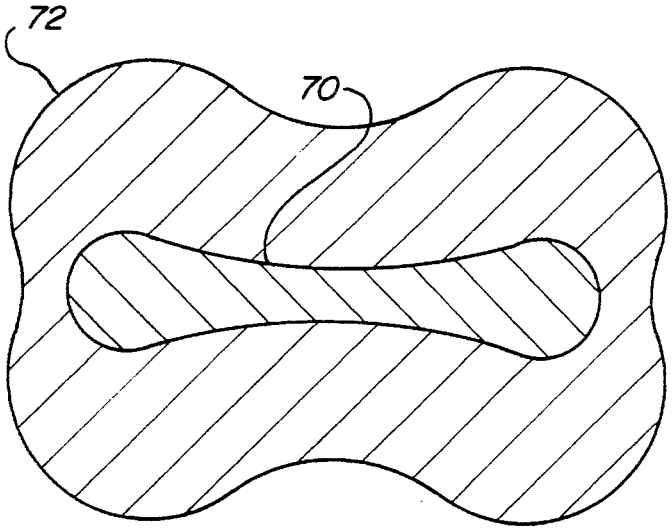
FIG. 7 is a spray fan pattern similar to FIG. 4 that is produced by the nozzle assembly of FIG. 6.

The air nozzle assembly 16 with four air nozzles 30 located on each side of the liquid spray nozzle 28 along a semi circular path as shown in FIG. 6 will produce a liquid spray fan pattern 70 and an air spray fan pattern 72 as shown in FIG. 7. Such a spray fan may provide a uniform layer of liquid urethane prepolymers on a pipe or other convex surface.

The spray wand 10 will, during operation, cover large areas with a layer of liquid urethane prepolymers quickly without a supply of compressed air to the air nozzles 30. Compressed air can be supplied to the air nozzles 30 to reduce the size of the liquid urethane prepolymer spray fan pattern 58 or 70 when a small area or strip of the substrate is to be covered. Reducing the size of the spray fan 58 will reduce the amount of over spray and thereby reduce the quantity of liquid urethane prepolymers required. Arranging the air nozzles 30, in a desired pattern, will vary the shape of the spray fan and the spray fan pattern 58 to provide uniform application of the liquid prepolymers.

There are a number of modifications that can be made to the spray wand 10 to obtain the desired distribution of liquid urethane prepolymers on a substrate. The location of the air nozzles has been mentioned above. Changes in the pressure of air supplied to the air nozzles has also been mentioned. In addition to the location of the air nozzles 30 and changes in the air pressure, it would be possible to provide air nozzles with different size orifices in one nozzle assembly. It would also be possible to supply air to some air nozzles 30 at one pressure and to supply air to other nozzles 30 in the same nozzle assembly 16 at a different pressure.

The center lines 62 of the orifices of the air nozzles 30 should be parallel to the center line 56 of the central liquid spray nozzle 28 to reduce mixing of air and liquid urethane prepolymer spray. The angle of the center lines 62 of the orifices in the air nozzles 30 can be angled toward or away from the center line 56 of the central liquid spray nozzle 28 up to five degrees with minimal mixing of air with the liquid spray. The change in the angle of the center line of the air nozzles can further change the size and shape of the spray fan of the liquid urethane prepolymers.

The spray wand 10 has been described above in use with a liquid urethane prepolymer. The spray wand 10 can be used with other materials to produce foams and other products. The spray wand 10 can be useful in processes in which it is desired to limit mixing of one spray material with other spray materials and to vary the size or shape of a liquid spray fan.

The spirit and scope of the present invention are limited only by the terms of the appended claims.

I claim:

1. A spray wand for applying a liquid to a substrate including a liquid spray nozzle which discharges the liquid in a first direction and produces a liquid spray fan with a predetermined shape; a supply line and pump system for supplying the liquid to the liquid spray nozzle;

at least two gas nozzles adjacent to the liquid spray nozzle which discharge a gas in a second direction that is substantially parallel to said first direction to alter the spray fan of the liquid discharged from the liquid spray nozzle;

a compressed gas supply line for supplying compressed gas to said at least two gas nozzles; said liquid spray nozzle and said at least two gas nozzles having discharge exits that are in a common plane; and a gas valve in the compressed gas supply line operable to discontinue the supply of the gas to the at least two gas nozzles thereby allowing the liquid to be discharged with the liquid spray fan having the unaltered predetermined shape.

2. A spray wand for applying a liquid to a substrate as set forth in claim 1 wherein the gas valve in the compressed gas supply line is operable to decrease the pressure of gas supplied to the gas nozzles thereby increasing the size of the altered liquid spray fan and is also operable to increase the pressure of gas supplied to the gas nozzles thereby decreasing the size of the altered liquid spray fan.

3. A nozzle assembly for a spray wand including a nozzle body comprising;

a liquid spray nozzle including an orifice through said nozzle body, having a liquid spray nozzle orifice center line and a liquid spray nozzle liquid discharge exit, that discharges a liquid without entrained air and produces a liquid spray fan with a predetermined shape;

a plurality of gas nozzles each of which includes an orifice through said nozzle body with a gas nozzle gas discharge exit and a gas nozzle orifice center line that is substantially parallel to the liquid spray nozzle orifice centerline; said liquid discharge exit and said gas discharge exits are positioned in a common plane; and wherein the plurality of gas nozzles are positioned in a predetermined pattern relative to the liquid spray nozzle to alter the predetermined shape of the liquid spray fan of the liquid spray nozzle.

4. A nozzle assembly for a spray wand as set forth in claim 3 wherein the predetermined pattern in which the gas nozzles are positioned is operable to reduce the size of the liquid spray fan.

5. A nozzle assembly for a spray wand as set forth in claim 3 wherein the predetermined pattern in which the gas nozzles are positioned is operable to alter the shape of the liquid spray fan.

6. A nozzle assembly for a spray wand as set forth in claim 3 wherein the predetermined pattern in which the gas nozzles are positioned is operable to alter the size and shape of the liquid spray fan.

7. A nozzle assembly for a spray wand as set forth in claim 3 wherein the gas nozzle orifice center lines are not more than five degrees from parallel with the liquid spray nozzle orifice center line.

8. A spray wand for applying a liquid urethane prepolymer to a substrate including a liquid spray nozzle, with an orifice having a liquid spray nozzle exit and a liquid spray nozzle orifice center line, operable to produce a spray fan with a predetermined shape;

a supply line and pump system for supplying the liquid urethane prepolymers to the liquid spray nozzle under pressure and forcing the liquid urethane prepolymer substantially free of entrained air from the liquid spray nozzle;

a plurality of gas nozzles each of which has an orifice with a gas nozzle exit and a gas nozzle orifice center line that is parallel to the liquid spray nozzle orifice center line; said gas nozzle exits are in a common plane with said liquid spray nozzle exit; a compressed gas supply line for supplying compressed gas to each of said gas nozzles; and a control valve for controlling the flow of gas to the gas nozzles and wherein the gas that passes through the gas nozzles is operable to completely surround the liquid urethane prepolymer spray from the liquid spray nozzle with the gas that is moving in the same general direction as said liquid urethane prepolymer spray, and decrease the size of the spray fax of the liquid urethane prepolymer sprayed from the liquid spray nozzle.

9. A method of applying a liquid spray with a spray wand having a liquid spray nozzle orifice with a center line and an exit, a plurality of gas nozzle orifices with gas nozzle orifice center lines that are substantially parallel to the liquid spray nozzle orifice center line and gas nozzle exits in a common plane with each other an with the liquid spray nozzle exit and a gas supply control operable to vary the quantity of gas passing through the gas nozzles including:

a. discharging only liquid through the liquid spray nozzle to produce a predetermined liquid spray fan;

b. discharging a gas through the gas nozzles to obtain an altered liquid spray fan with the desired liquid spray fan size and shape;

c. changing the pressure of gas supplied to the gas nozzle orifices to change the size of the altered liquid spray fan; and d. minimizing the mixing of the liquid and the gas by discharging both liquid and gas in substantially the same direction in generally parallel paths from said common plane.

10. A method of applying a liquid spray as set forth in claim 9 wherein the pressure of gas supplied to the gas nozzle orifices is increased to decrease the size of the altered liquid spray fan.

11. A method of applying a liquid spray as set forth in claim 9 wherein the pressure of gas supplied to the gas nozzle orifices is decreased to increase the size of the altered liquid spray fan.

12. A method of applying a liquid spray as set forth in claim 9 wherein the pressure of gas supplied to the gas nozzle orifices is decreased to zero by stopping the flow of gas to the nozzles thereby producing the predetermined liquid spray fan with a larger area than the altered liquid spray fan.

* * * * *